US005419353A

United States Patent [19]

Chen

[11] Patent Number: 5,419,353

[45] Date of Patent: May 30, 1995

[54] OBJECT CLEANING AND WASHING DEVICE

[76] Inventor: Hong-wel Chen, No. 31 Guang-Ming Rd., Da-Jia Town, Taichung County, Taiwan, Prov. of China

[21] Appl. No.: 237,932

[22] Filed: May 4, 1994

[51] Int. Cl.[6] ..... B08B 5/00

[52] U.S. Cl. ..... 134/102.1; 134/111; 134/110; 134/102.2

[58] Field of Search ..... 134/102.1, 135, 102.2, 134/102.3, 111, 109, 110; 68/207, 181 R

[56] References Cited

U.S. PATENT DOCUMENTS

| | | | |
|---|---|---|---|
| 1,036,988 | 8/1912 | Fink | 134/111 |
| 4,967,777 | 11/1990 | Takayama et al. | 134/102.1 |
| 5,000,794 | 3/1991 | Chung | 134/102.1 |
| 5,014,727 | 5/1991 | Aigo | 134/902 |
| 5,161,394 | 11/1992 | Felzer et al. | 68/207 |
| 5,279,316 | 1/1994 | Miranda | 134/902 |

FOREIGN PATENT DOCUMENTS

| | | | |
|---|---|---|---|
| 4-192419 | 7/1992 | Japan | 134/902 |
| 5-82496 | 4/1993 | Japan | 134/902 |

*Primary Examiner*—Frankie L. Stinson
*Attorney, Agent, or Firm*—Bacon & Thomas

[57] ABSTRACT

A washing device includes a housing having a room formed in the inner portion for receiving water and objects to be cleaned. A conduit is secured to the lower portion of the housing, a number of holes are formed in the housing for communicating the conduit with the room. A blower is connected to the conduit for supplying air bubbles into the room via the conduit and for cleaning and washing the objects.

1 Claim, 4 Drawing Sheets

OBJECT CLEANING AND WASHING DEVICE

BACKGROUND OF THE INVENTION

1. Field of the Invention

The present invention relates to a washing device, and more particularly to a cleaning and washing device for washing objects.

2. Description of the Prior Art

Typically, vegetables are washed manually. However, normally, vegetables may not be easily and thoroughly washed and cleaned. Typical dish cleaning devices may provide water jets for cleaning dishes.

The present invention has arisen to provide a novel cleaning and washing device for washing objects including dishes and vegetables.

SUMMARY OF THE INVENTION

The primary objective of the present invention is to provide a cleaning and washing device for cleaning objects including dishes and vegetables.

In accordance with one aspect of the invention, there is provided a washing device comprising a housing including a wall member defining a room therein for receiving water and objects to be cleaned, the housing including an upper portion and a lower portion, a conduit secured to the lower portion of the housing, a plurality of holes formed in the wall member for communicating the conduit with the room, a blower connected to the conduit for supplying air bubbles into the room via the conduit for cleaning and for washing the objects.

The wall member includes a front portion, a rear portion and two side portions, a pair of grooves formed in the front portion and the rear portion of the wall member, and the washing device further includes a screen having two ends slidably engaged in the grooves such that the screen is movable along the grooves.

The room includes a bottom portion having a recess formed therein, the recess includes an outlet formed therein for discharging water. The upper portion of the housing includes at least one exit formed therein and connected to the outlet for discharging excessive water. The conduit is disposed around the lower portion of the housing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
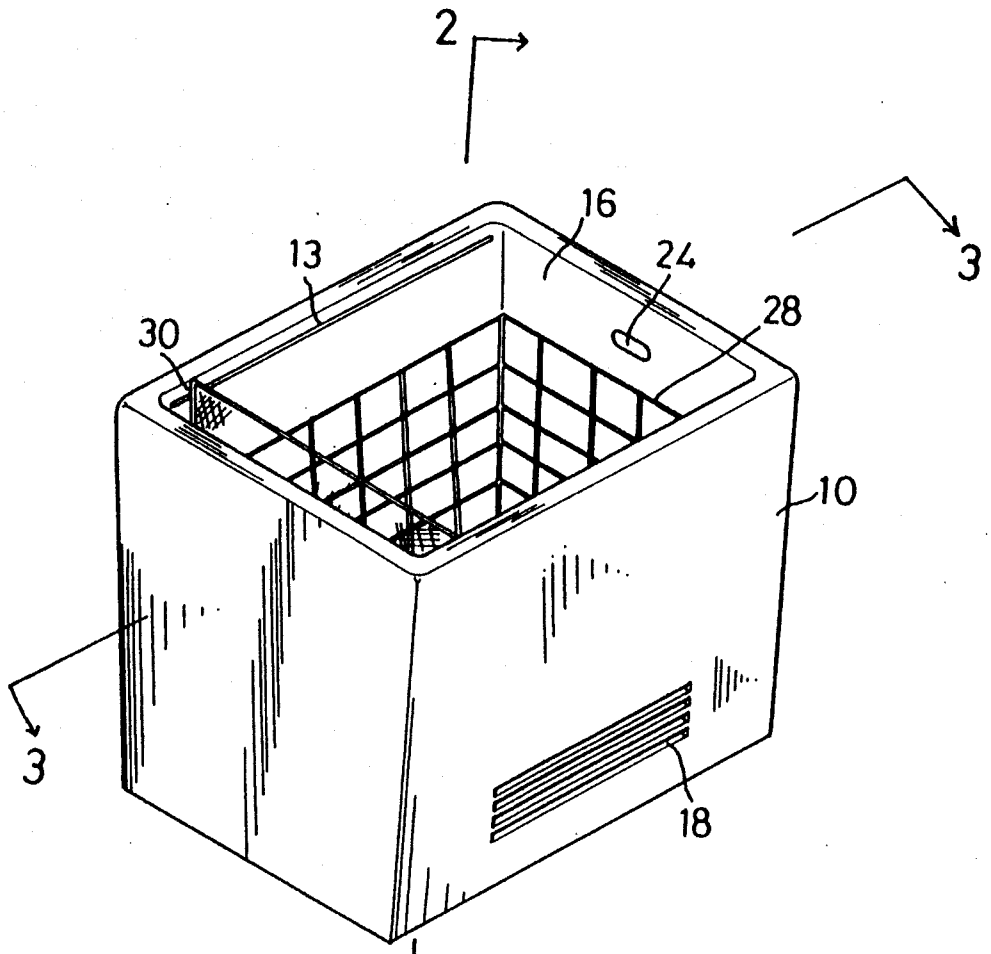
FIG. 1 is a perspective view of a washing device in accordance with the present invention.
Figure 2:
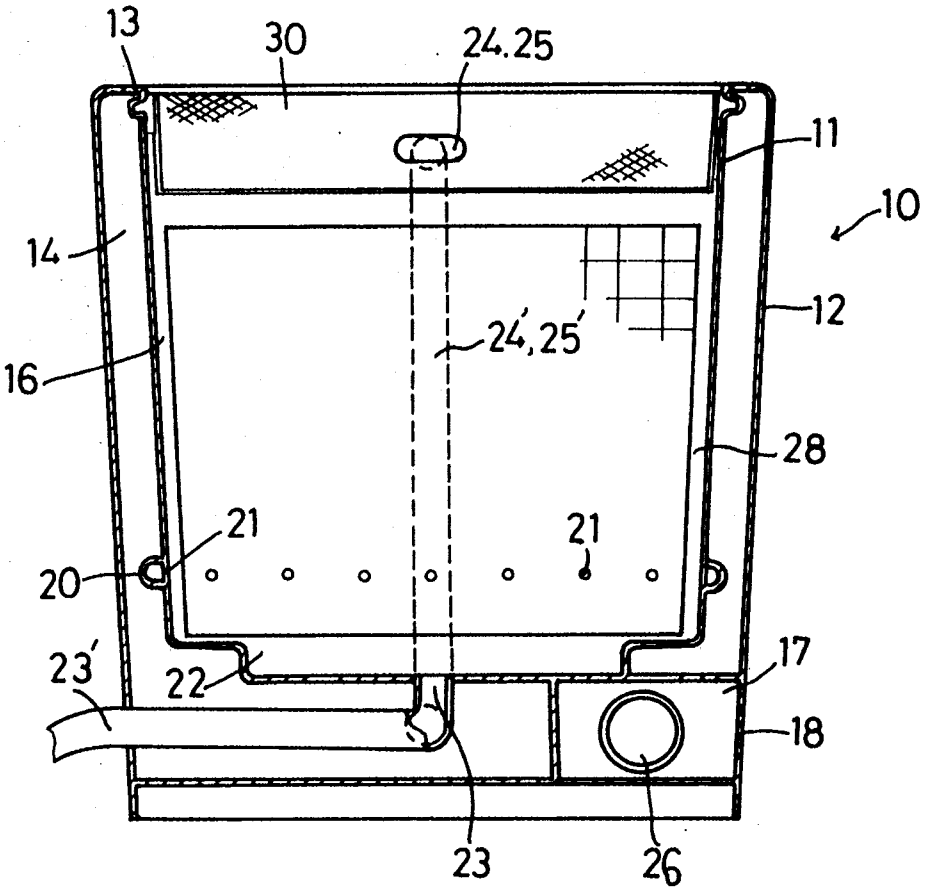
FIGS. 2 and 3 are cross sectional views taken along lines 2—2 and 3—3 of FIG. 1 respectively.
Figure 3:
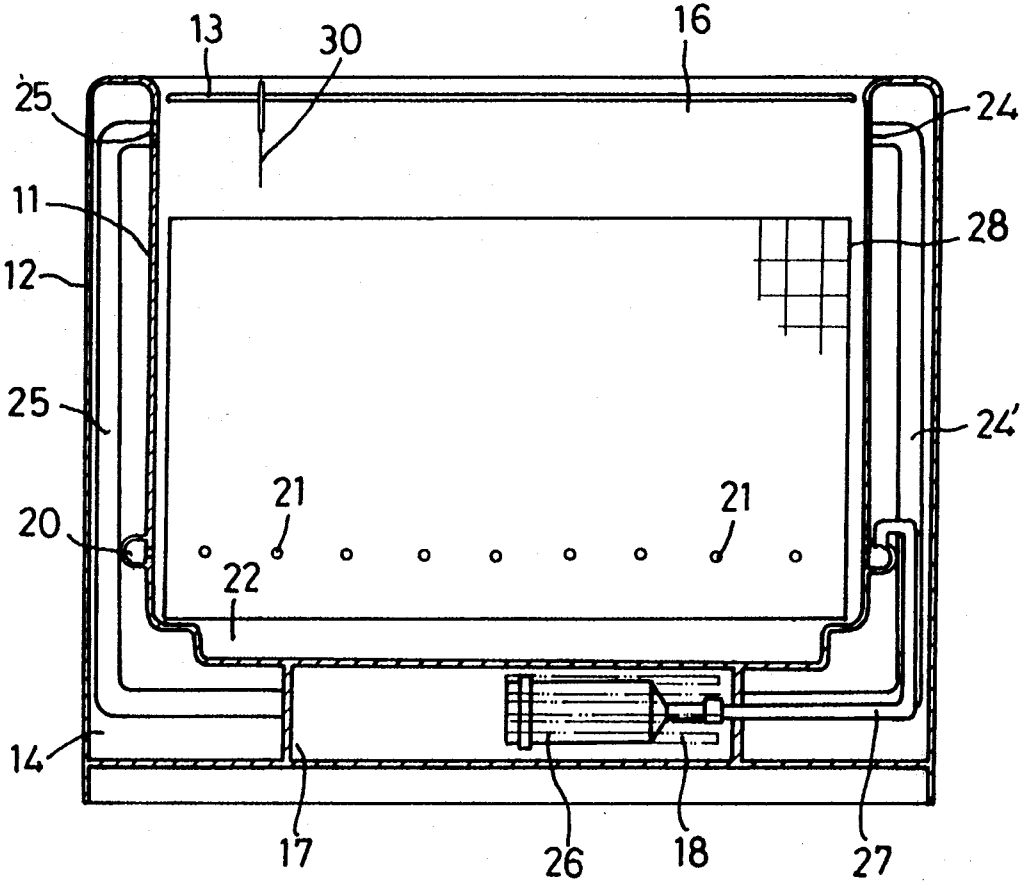

Referring to the drawings, and initially to FIGS. 1 to 3, an object cleaning and washing device in accordance with the present invention comprises a container 10 including base 17 and including a peripheral fence defining a room 16 therein for receiving water and objects to be cleaned. The fence includes an outer wall 12 and an inner wall 11 so as to form a chamber 14 therein. The fence includes a front portion, a rear portion and two side portions. A pair of grooves 13 are formed in the inner wall 11 of the front portion and the rear portion of the fence. A screen 30 includes two ends slidably engaged in the grooves 13 such that the screen 30 may move along the grooves 13 for removing floating impurities. Two exits 24, 25 are oppositely formed in the inner wall 11 of the side portions of the fence for discharging excessive water. A gratelike basket 28 may be disposed in the room 16 for accommodating the objects to be washed.

A conduit 20 is formed in the chamber 14 and formed around the lower peripheral portion of the inner wall 11. A number of holes 21 are formed in the inner wall 11 for communicating the conduit 20 to the room 16. At least one blower 26 is disposed in the base 17 and is connected to the conduit 20 by a tube 27 so as to supply air bubble into the water contained in the room 16. A number of openings 18 are formed in the bottom portion of the housing 10 and located close to the blower 26 for dissipating heat generated by the blower 26 and for communicating the base 17 with the environment. A recess 22 is formed in the bottom portion of the room 16 and located below the basket 28. An outlet 23 is formed in the bottom portion of the recess 22 and connected to a pipe 23'. Two hoses 24', 25' connect the exits 24, 25 to the pipe 23' which extends outward of the housing 10 for discharging water. A valve means may be engaged in the pipe 23' for controlling the discharging water flow.

Figure 4:
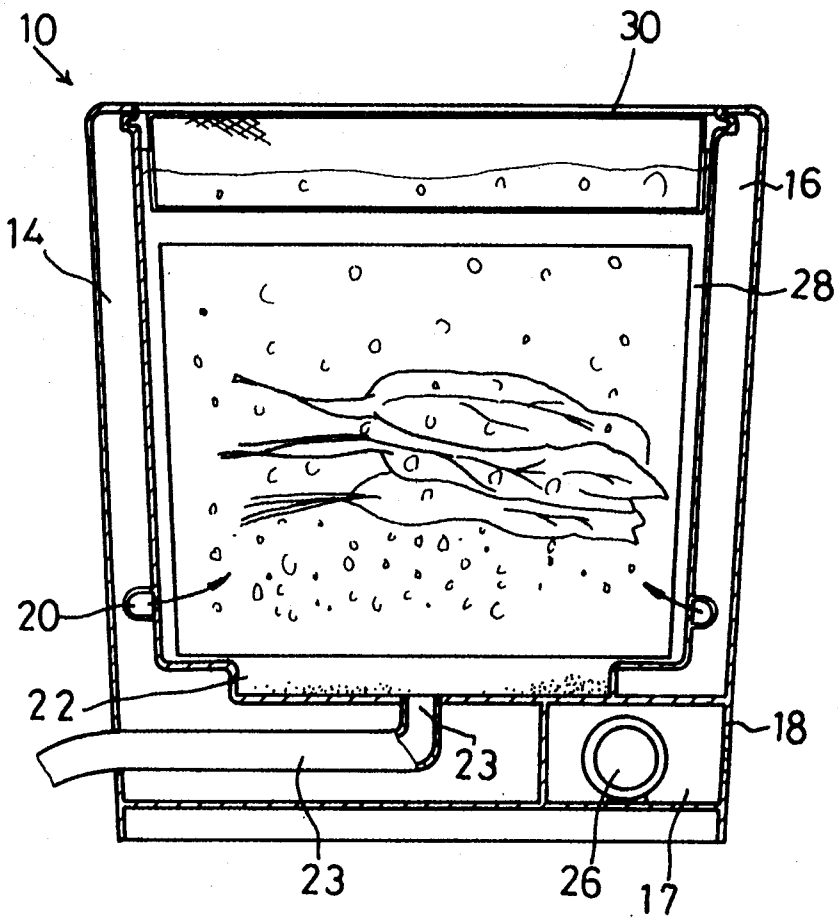
FIG. 4 is a cross sectional view similar to FIG. 2, illustrating the operation of the washing device.

In operation, as shown in FIG. 4, the air generated by the blower 26 may be supplied into the water received in the room 16 via the conduit 20 and the holes 21 in order to stir up the water for cleaning and washing the dishes or vegetable disposed in the room 16. Grains or heavier contaminants may deposit in the recess 22 and may be discharged out via the outlet 23 and the pipe 23'. Lighter contaminants may float on the water and may be moved into the hoses 24, 25' and the pipe 23' via either of the exits 24, 25. The washed vegetable or dishes may be easily moved out of the room 16 by the basket 28.

Accordingly, the object cleaning and washing device in accordance with the present invention includes a blower for generating air bubbles within the water for cleaning and washing the objects to be washed.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A washing device comprising:

(a) a housing including an upper portion and a lower portion and including a wall member defining a room therein for receiving water and objects to be cleaned, said room including a bottom portion having a recess formed therein, said recess including an outlet formed therein for discharging water, said upper portion of said housing including at least one exit formed therein and connected to said outlet for discharging excessive water, said wall member including a front portion, a rear portion and two side portions, a pair of grooves formed in said front portion and said rear portion of said wall member and formed in said upper portion of said housing, (b) a gratelike basket disposed in said room for accommodating the objects to be cleaned, (c) a conduit secured to said lower portion of said housing and disposed around said lower portion of said housing, a plurality of holes formed in said wall member for communicating said conduit with said room, (d) a blower connected to said conduit for supplying air bubbles into said room via said conduit and for cleaning and washing said objects, and (e) a screen having two ends slidably engaged in said grooves of said upper portion of said housing so as to allow said screen moving along said grooves for removing floating impurities.

* * * * *